US007066356B2

(12) United States Patent
Schuman et al.

(10) Patent No.: US 7,066,356 B2
(45) Date of Patent: Jun. 27, 2006

(54) FOAM SOAP DISPENSER FOR PUSH OPERATION

(75) Inventors: Allan L. Schuman, Eden Prairie, MN (US); Tina O. Outlaw, Inver Grove Heights, MN (US); Darren M. Jahnke, Woodbury, MN (US); Louis M. Holzman, St. Paul, MN (US); Randall S. Williams, Chaska, MN (US); Paul A. Pilosi, Minnetonka, MN (US); Timothy W. Kidder, St. Paul, MN (US)

(73) Assignee: Ecolab Inc., St.Paul, MN (US)

( * ) Notice: Subject to any disclaimer, the term of this patent is extended or adjusted under 35 U.S.C. 154(b) by 316 days.

(21) Appl. No.: 10/336,054

(22) Filed: Jan. 2, 2003

(65) Prior Publication Data

US 2004/0031816 A1 Feb. 19, 2004

Related U.S. Application Data

(60) Provisional application No. 60/403,670, filed on Aug. 15, 2002.

(51) Int. Cl.
*B67D 5/06* (2006.01)

(52) U.S. Cl. ..... 222/153.01; 222/181.3; 222/325

(58) Field of Classification Search ..... 222/153.01, 222/181.3, 183, 325, 380
See application file for complete search history.

(56) References Cited

U.S. PATENT DOCUMENTS 2,923,443 A * 2/1960 Sundholm ..... 222/380
3,121,514 A * 2/1964 Kaplan et al. ..... 222/246
4,018,363 A 4/1977 Cassia ..... 222/80
4,146,156 A 3/1979 Cassia ..... 222/181
4,149,573 A 4/1979 Cassia ..... 141/18
4,164,306 A * 8/1979 Perrin ..... 222/181.2
4,173,858 A 11/1979 Cassia ..... 53/471
4,214,676 A 7/1980 Cassia ..... 222/83.5
4,316,555 A 2/1982 Smith ..... 222/83.5
4,322,019 A 3/1982 Smith ..... 222/83.5
4,345,627 A 8/1982 Cassia ..... 141/18
4,391,308 A 7/1983 Steiner ..... 141/18
4,391,309 A 7/1983 Steiner ..... 141/18
4,429,812 A 2/1984 Steiner et al. ..... 222/181
4,560,093 A 12/1985 Cassia ..... 222/181
4,570,823 A 2/1986 Arabian et al. ..... 222/26
4,570,829 A * 2/1986 Allen ..... 222/207
4,576,313 A 3/1986 Smith et al. ..... 222/81

(Continued)

FOREIGN PATENT DOCUMENTS

EP 0 019 582 A1 11/1980

(Continued)

*Primary Examiner*—Joseph A. Kaufman
(74) *Attorney, Agent, or Firm*—IPLM Group, P.A.

(57) ABSTRACT

The present invention is a foam soap dispenser (10) for push operation. The dispenser (10) houses a product bottle (18 and 18'), and the dispenser (10) includes lock-out members (12*a* and 12*b*) while the product bottle (18 and 18') includes mating lock-out members (19*a*, 19*b*, and 19') to ensure that the correct product is used with the dispenser (10). The dispenser (10) includes a push handle (13) that pivots on a pivot point (16) to dispense product when the push handle (13) is compressed. Pushing the push handle (13) moves the handle lever assembly (25 and 25') components, which in turn activates a product outlet (23) to dispense the product. As the handle (13) is being compressed and released, a gap (22) is created and an anti-pinch member (14) helps prevent pinching of the hand.

8 Claims, 5 Drawing Sheets

U.S. PATENT DOCUMENTS

| | | | | | |
|---|---|---|---|---|---|
| 4,646,945 | A | | 3/1987 | Steiner et al. | 222/207 |
| 4,673,109 | A | | 6/1987 | Cassia | 222/153 |
| 4,690,307 | A | * | 9/1987 | Hogan | 222/95 |
| 4,886,192 | A | | 12/1989 | Cassia | 222/181 |
| 4,930,667 | A | | 6/1990 | Holzner, Sr. | 222/189 |
| 5,082,150 | A | | 1/1992 | Steiner et al. | 222/189 |
| 5,173,216 | A | | 12/1992 | Uhlig | 252/547 |
| 5,174,476 | A | | 12/1992 | Steiner et al. | 222/181 |
| 5,240,147 | A | * | 8/1993 | Frazier et al. | 222/153.03 |
| 5,271,560 | A | * | 12/1993 | De Winter | 239/42 |
| 5,287,996 | A | | 2/1994 | Uhlig | 222/189 |
| 5,377,871 | A | * | 1/1995 | Banks et al. | 222/41 |
| 5,398,845 | A | | 3/1995 | Meyer | 222/1 |
| 5,421,489 | A | | 6/1995 | Holzner, Sr. et al. | 222/207 |
| 5,439,140 | A | | 8/1995 | Meyer | 222/110 |
| 5,439,144 | A | | 8/1995 | Holzner | 222/189.06 |
| 5,544,788 | A | | 8/1996 | Meyer | 222/110 |
| 5,779,104 | A | | 7/1998 | Reidel | 222/190 |
| 6,321,943 | B1 | * | 11/2001 | Strickler et al. | 222/82 |

FOREIGN PATENT DOCUMENTS

| | | | |
|---|---|---|---|
| EP | 0 114 026 | A1 | 7/1984 |
| EP | 0 114 569 | A1 | 8/1984 |
| EP | 0 209 223 | A1 | 1/1987 |
| EP | 0 219 931 | A2 | 4/1987 |
| EP | 0 232 571 | B1 | 8/1987 |
| EP | 0 380 204 | B1 | 8/1990 |
| EP | 0 389 648 | B1 | 10/1990 |
| EP | 0 455 431 | B1 | 11/1991 |
| EP | 0 459 050 | A1 | 12/1991 |
| EP | 0 459 050 | B1 | 12/1991 |
| EP | 0 459 943 | B1 | 12/1991 |
| EP | 0 663 175 | B1 | 7/1995 |
| EP | 0 940 110 | B1 | 9/1999 |
| EP | 1 118 300 | A1 | 7/2001 |
| EP | 1 118 301 | A1 | 7/2001 |
| EP | 1 118 389 | A1 | 7/2001 |
| GB | 1 409 845 | | 10/1975 |
| GB | 2 301 812 | A | 12/1996 |
| JP | 07 322969 | | 7/1995 |
| WO | WO 01/52708 | A1 | 7/2001 |
| WO | WO 01/52709 | A1 | 7/2001 |
| WO | WO 01/52710 | A1 | 7/2001 |
| WO | WO 01/53002 | A1 | 7/2001 |

* cited by examiner

FOAM SOAP DISPENSER FOR PUSH OPERATION

This application claims the benefit of U.S. Provisional Application No. 60/403,670, filed Aug. 15, 2002.

BACKGROUND OF THE INVENTION

1. Field of the Invention

The present invention relates to a foam soap dispenser for push operation.

2. Description of the Prior Art

Various types of soap dispensers are installed near sinks in restrooms. Typically, the soap dispenser houses a soap supply and generates and discharges a metered amount of soap from the soap supply with a simple actuation of a handle by a hand. Foam soaps are generally preferred over conventional liquid and gel hand soaps because they lather faster, have better coverage, and rinse more easily. Further, because less soap is typically used and there is less product waste, the soap supply must be replenished less frequently.

One type of foam soap dispenser is disclosed in U.S. Pat. No. 5,779,104 by Reidel. This pull-type dispenser generates and meters pre-foamed soap. To prevent further dispensing of drips of residual foam in an outlet channel after the desired quantity has been dispensed, the dispenser is constructed in such as way that the underpressure subsisting on the return stroke of a piston in an air chamber is effective in the foam outlet channel and sucks residual foam back into the dispenser. This no clog, anti-drip pump mechanism prevents wasteful spills and prevents unsightly leaks. Also, a reservoir allows the product bottle to be replaced before the product supply discharges completely from the dispenser, which assures a continuous supply of product without wasting product. This dispenser is a pull handle type dispenser.

Soap dispensers are often mounted to a surface in a manner in which pull operation could cause the dispenser to be pulled off the surface. Therefore, it is often desirable to utilize a push handle type dispenser to reduce the likelihood that the dispenser will be pulled off the mounting surface.

SUMMARY OF THE INVENTION

A preferred embodiment dispensing system for dispensing a product includes a dispenser, a bottle, an anti-pinch member, and a handle lever assembly. The dispenser includes a housing, a push handle, and a pivot point to which the push handle is operatively connected. The housing has a cavity, a first inner surface and a second inner surface. The first inner surface includes a first lock-out member and the second inner surface includes a second lock-out member. The bottle includes a first mating lock-out member and a second mating lock-out member. The first mating lock-out member is configured and arranged to mate with the first lock-out member and the second mating lock-out member is configured and arranged to mate with the second lock-out member when the bottle is placed within the cavity of the dispenser. The anti-pinch member includes a curved surface and a lip proximate a top portion of the curved surface. The curved surface fills a gap between the housing and the push handle when the push handle is compressed, and the lip extends outward from the curved surface to close off the gap proximate the top portion of the curved surface. The handle lever assembly includes a push bar lever, a motion bar, a rotation lever, and a draw bar. The push bar lever extends relatively upwardly and includes a first pivot point proximate a top portion thereof and a first attachment point in a middle portion thereof. The motion bar is operatively connected to the first attachment point and extends relatively horizontally from the push bar lever, and the motion bar includes a second attachment point in an end opposite the first attachment point. The rotation lever is operatively connected to the second attachment point and extends relatively downward from the motion bar. The rotation lever includes a third attachment point in a middle portion thereof and a second pivot point below the third attachment point. The draw bar is operatively connected to the third attachment point of the rotation lever, wherein when the push bar lever is pushed inward the push bar lever pivots at the first pivot point thereby causing the motion bar to move backward toward a back portion of the dispenser. The rotation lever pivots at the second pivot point and rotates clockwise thereby causing the draw bar to move backward toward the back portion of the dispenser.

A preferred embodiment handle lever assembly for use with a product dispenser having a push handle includes a push bar, a motion bar, a rotation lever, and a draw bar. The push bar lever extends relatively upwardly and includes a first attachment point in a middle portion thereof. The motion bar is operatively connected to the first attachment point and extends relatively horizontally from the push bar lever. The motion bar includes a second attachment point in an end opposite the first attachment point. The rotation lever is operatively connected to the second attachment point and extends relatively downward from the motion bar. The rotation lever includes a third attachment point in a middle portion thereof and includes multiple points of attachment between the second attachment point and the third attachment point. The draw bar is operatively connected to the rotation lever, and the draw bar is adjustable along the multiple points of attachment and the third attachment point of the rotation lever to operatively connect thereto.

A preferred embodiment handle lever assembly for use with a product dispenser having a push handle includes a push bar, a motion bar, a rotation lever, and a draw bar. The push bar lever extends relatively upwardly and includes a first pivot point proximate a top portion thereof and a first attachment point in a middle portion thereof. The motion bar is operatively connected to the first attachment point and extends relatively horizontally from the push bar lever. The motion bar includes a second attachment point in an end opposite the first attachment point. The rotation lever is operatively connected to the second attachment point and extends relatively downward from the motion bar. The rotation lever includes a third attachment point in a middle portion thereof and a second pivot point below the third attachment point. The draw bar is operatively connected to the third attachment point of the rotation lever, wherein when the push bar lever is pushed inward the push bar lever pivots at the first pivot point thereby causing the motion bar to move backward toward a back portion of the dispenser, the rotation lever pivots at the second pivot point and rotates clockwise thereby causing the draw bar to move backward toward the back portion of the dispenser.

A preferred embodiment anti-pinch member for use with a dispenser includes a curved surface and a lip. The dispenser includes a housing, a push handle for dispensing a product, and a pivot point to which the push handle is operatively connected. The housing covers the pivot point and a portion of the push handle operatively connected to the pivot point, wherein a gap is created proximate the pivot point between the housing and the push handle when the push handle is compressed. The curved surface fills the gap between the housing and the push handle when the push handle is compressed. The lip is proximate a top portion of the curved surface, and the lip extends outward from the curved surface to close off the gap proximate the top portion of the curved surface.

A preferred embodiment lock-out system includes a dispenser and a bottle. The dispenser includes a housing, and the housing has a cavity, a first inner surface and a second inner surface. The first inner surface includes a first lock-out member and the second inner surface includes a second lock-out member. The bottle includes a first side and a second side. The first side has a first mating lock-out member and the second side has a second mating lock-out member. The first mating lock-out member is configured and arranged to mate with the first lock-out member and the second mating lock-out member is configured and arranged to mate with the second lock-out member when the bottle is placed within the cavity of the dispenser.

DETAILED DESCRIPTION OF THE PREFERRED EMBODIMENT

Figure 1:
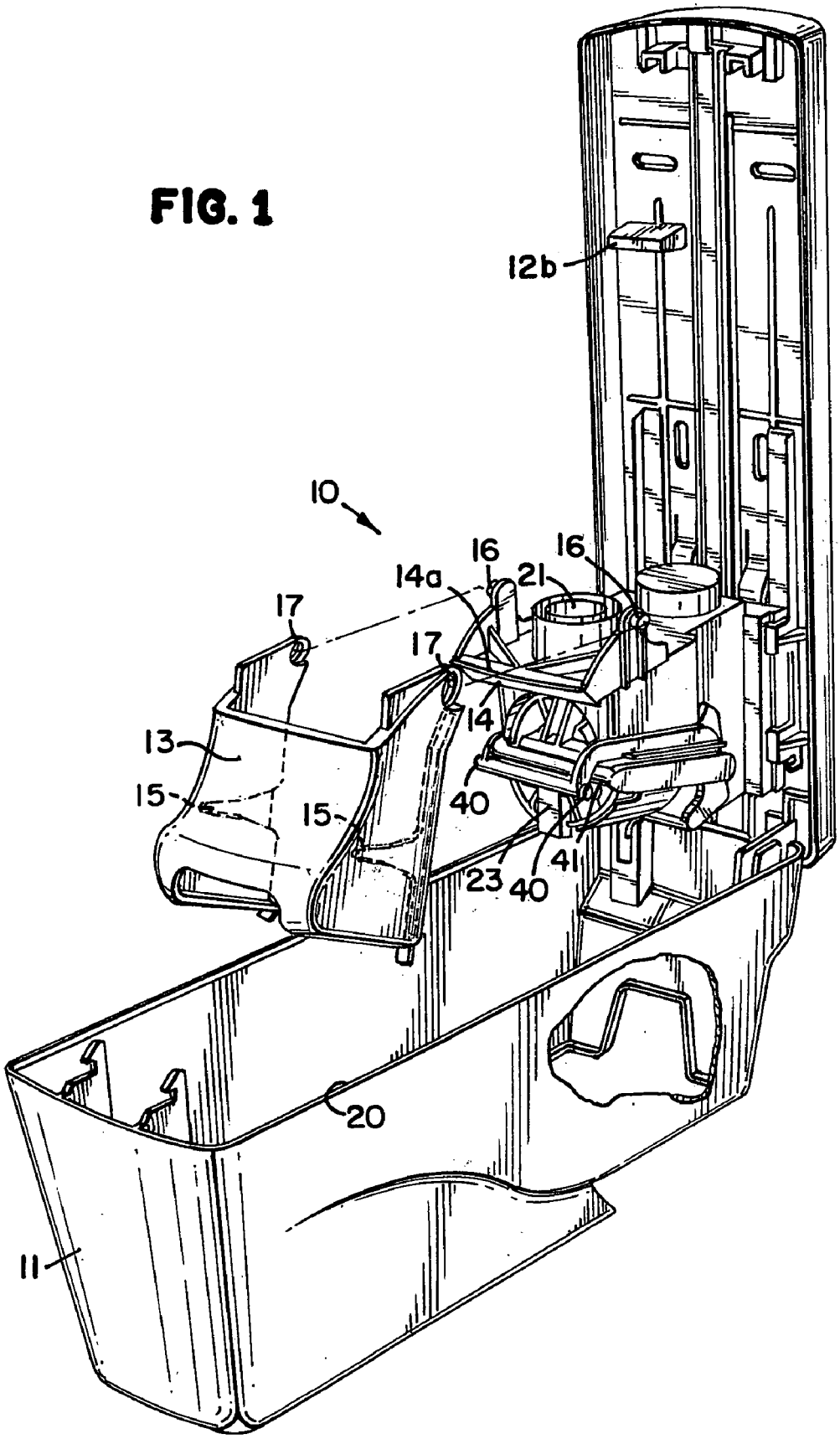
FIG. 1 is a side perspective view of a dispenser with a handle exploded from the dispenser constructed according to the principles of the present invention.

A dispenser handle lever assembly constructed according to the principles of the present invention is designated by the numerals 25 and 25' in the drawings. The handle lever assembly 25 and 25' is for use with a product dispenser designated by the numeral 10 in the drawings.

In the preferred embodiment, the dispenser 10 is of the type disclosed in U.S. Pat. No. 5,779,104 by Reidel, which is incorporated by reference herein. This patent discloses a dispenser for generating and metering foam, especially pre-foamed soap, and the dispenser includes a pull handle to dispense the soap. However, the present invention is a push handle dispenser, and the handle pivots at the front rather than at the back of the dispenser. Therefore, the dispenser of the present invention is a modification of U.S. Pat. No. 5,779,104 by Reidel to operate in a push mode rather than in a pull mode. More specifically, the dispenser has been retrofitted to accommodate the handle lever assembly components of the present invention, which is described in more detail below. The pull clip 29 is operated by the lever 30 in U.S. Pat. No. 5,779,104 while the draw bar 36 of the present invention is moved in the same direction as the clip 29 by pushing rather than pulling. The present invention may be retrofitted for use with other dispensers as well.

Figure 5:
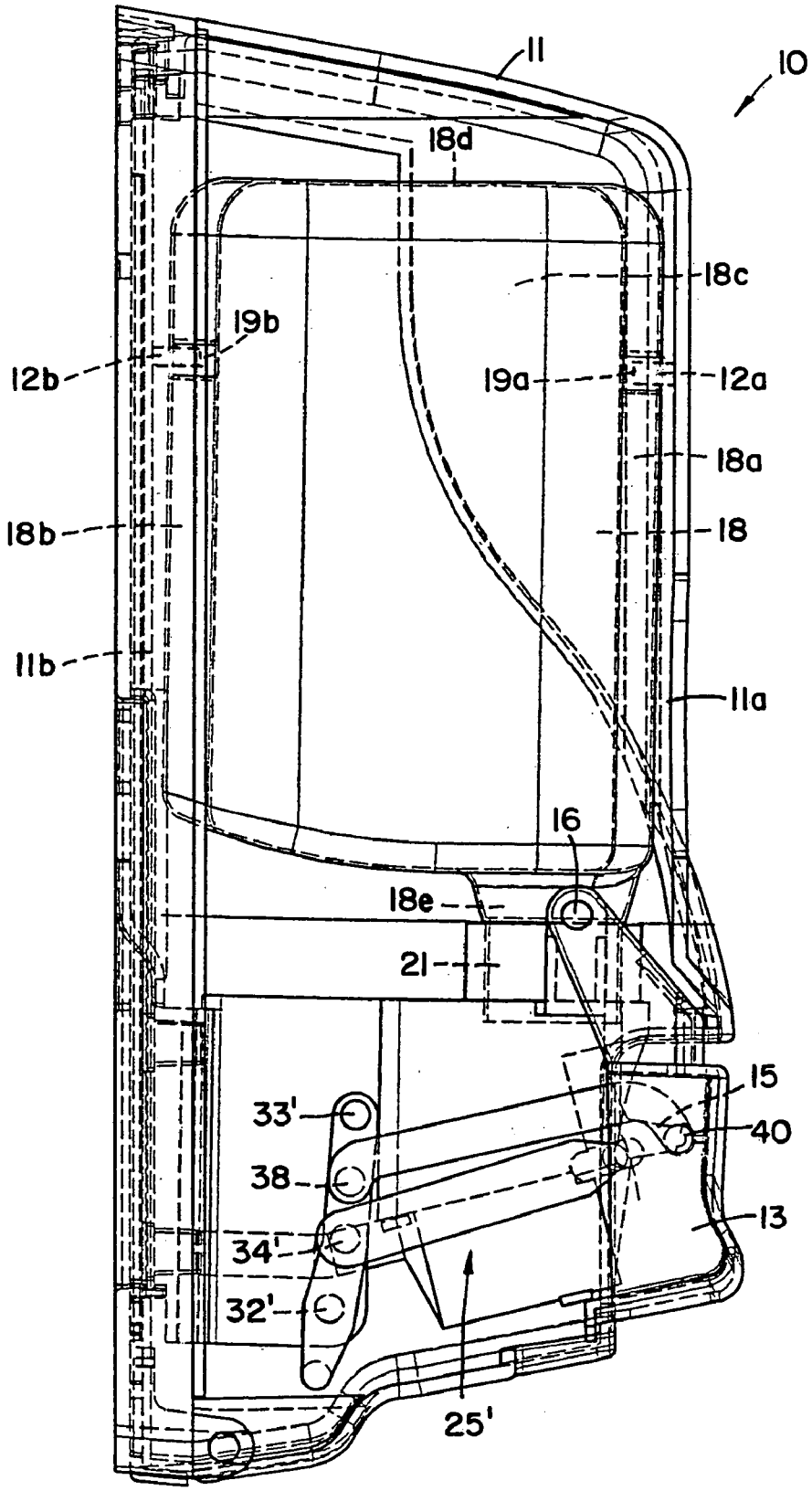
FIG. 5 is a left side assembly view of the dispenser and a product bottle.

As shown in FIGS. 1 and 5, the dispenser 10 includes a housing 11 with a cavity 20 and lock-out members 12*a* and 12*b*, a push handle 13, and an anti-pinch member 14. In FIG. 5, a product bottle 18 containing product is placed within the cavity 20 of the housing 11 in a docking station 21, and the bottle 18 includes mating lock-out members 19*a* and 19*b*, which cooperate with the lock-out members 12*a* and 12*b*, respectively. The spout 18*e* of the bottle 18 is configured and arranged to mate with the docking station 21. In the preferred embodiment, the lock-out members 12*a* and 12*b* protrude from the inner surface of housing 11 while the mating lock-out members 19*a* and 19*b* are notches or indentations in the bottle 18. Therefore, the lock-out members 12*a* and 12*b* are configured and arranged to fit within the notches 19*a* and 19*b* to ensure that the correct product is being used with the dispenser 10.

In the preferred embodiment, the lock-out member 12*a* and the mating lock-out member 19*a* are located at the front of the dispenser 10, and the lock-out member 12*b* and the mating lock-out member 19*b* are located at the back of the dispenser 10 thereby being on opposing sides. More specifically, the lock-out member 12*a* protrudes from the front inner surface 11*a* of the housing 11, the lock-out member 12*b* protrudes from the back inner surface 11*b* of the housing 11, the mating lock-out member 19*a* is in the front 18*a* of the bottle 18, and the mating lock-out member 19*b* is in the back 18*b* of the bottle 18. Having the lock-out features on opposing sides helps prevent the bottle 18 from deforming around both of the lock-out members thereby excluding the use of the wrong product. The lock-out features may be located at any elevation and do not have to be located at the same elevation. It is recognized that these lock-out features may be located anywhere on the dispenser and the bottle, including on the sides 18*c* interconnecting the front 18*a* and the back 18*b* and on the bottom 18*d* of the bottle 18 opposite the spout 18*e*, as long as the lock-out features remain effective to exclude products that should not be used with the dispenser 10. They do not have to be on opposing sides to be effective.

Figure 6:
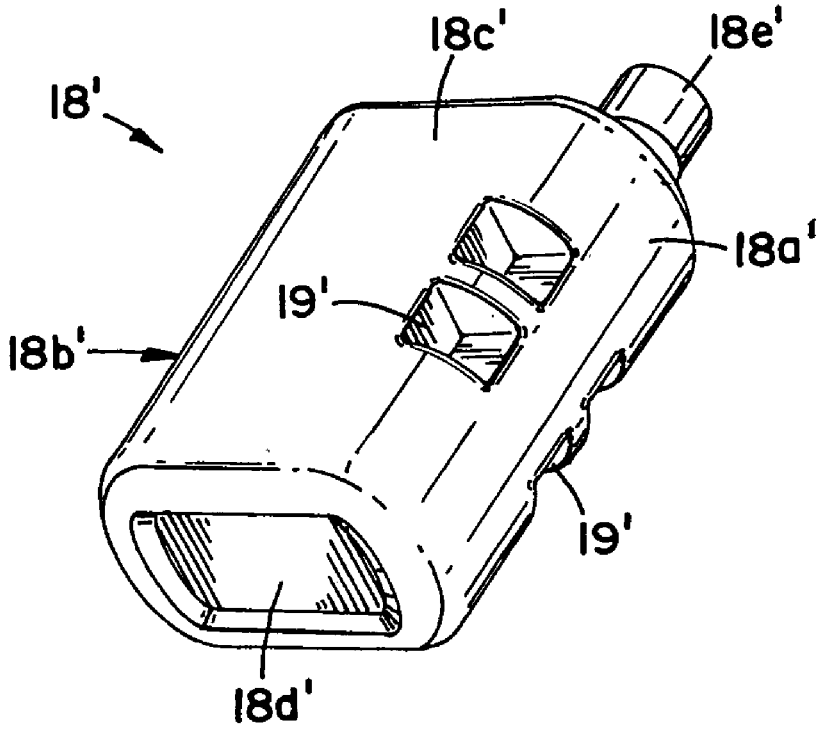
FIG. 6 is a perspective view of a product bottle for use with the dispenser.

The lock-out features may even be located on the same side of the dispenser and there could be more than two lock-out features. As shown in FIG. 6, the bottle 18' includes four mating lock-out members 19' on the front 18*a'* of the bottle 18', and the dispenser 10 would include cooperating lock-out members on the front of the dispenser 10. Again, it is recognized that these lock-out features could be located on the back 18*b'*, on the side 18*c'*, or on the bottom 18*d'* opposite the spout 18*e'*. Further, the protrusions and the notches or indentations may be reversed on the dispenser and the bottle, and other means well known in the art may be used to act as a lock-out feature. Because the product bottle 18 or 18' may be of a flexible material such as plastic, one lock-out member may not prevent usage of a different product because the bottle 18 or 18' may deform around the lock-out member to fit within the housing 11. Therefore, placing more than one lock-out member within the housing 11 helps prevent usage of a different product because the bottle 18 or 18' will be less likely to deform in two or more places and still fit within the housing 11.

Figure 2:
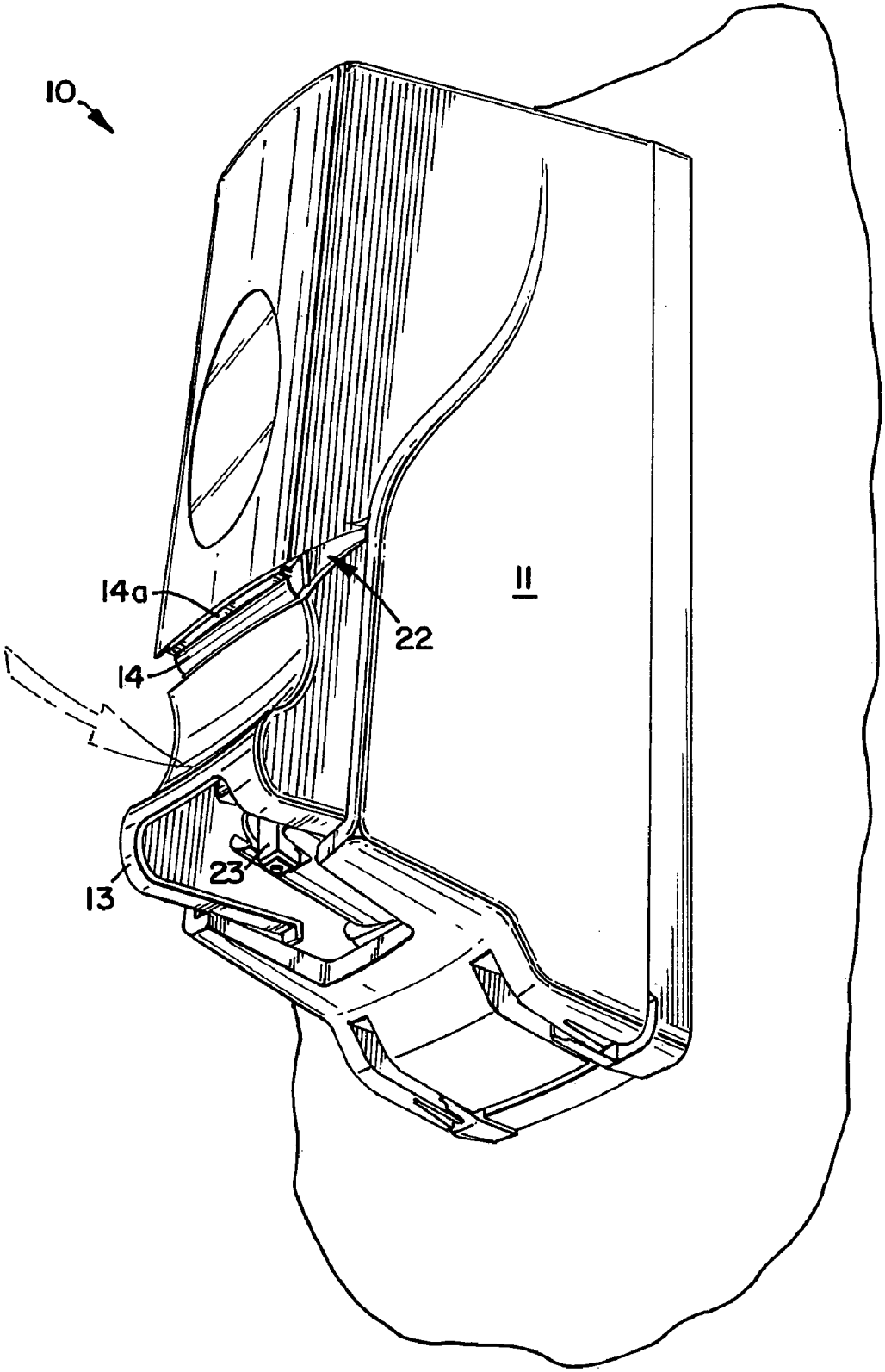
FIG. 2 is a front perspective view of the dispenser shown in FIG. 1 with the handle compressed.

An anti-pinch member 14 is placed proximate the top of the push handle 13 to help prevent pinching of the hand as the handle 13 is compressed and released to dispense the soap, as shown in FIG. 2. The anti-pinch member 14 extends from proximate the pivot points 16 on the dispenser 10 to which the handle 13 is operatively connected. More specifically, the pivot points 16 are pegs that are configured and arranged to pivotably engage apertures 17 proximate the top, back portion of the handle 13, which is shown in FIG. 1. When the handle 13 is compressed and pushed to a back position, a gap 22 is created proximate the pivot points 16 between the handle 13 and the housing 11. The anti-pinch member 14 is a curved surface to fill this gap 22. The curved surface has a lip 14*a* extending outwardly therefrom proximate the top of the anti-pinch member 14 to close off the gap near the top of the gap 22. Without the anti-pinch member 14, it would be possible for some skin to get pinched between the handle 13 and the housing 11 as the handle 13 is released and retracts to the forward position.

The handle lever assembly 25 or 25' is operatively connected to the handle 13 and the dispenser 10, as shown in FIG. 1. The handle 13 includes slots 15 proximate the middle of the handle 13, and pegs 40 extending outward from an attachment point 28 or 28' are configured and arranged to slide within the slots 15 when operatively connecting the handle 13 to the dispenser 10. The slots 15 are recessed areas on the inner surface of the handle 13 and do not extend to the outer surface. To operatively connect the handle 13 to the dispenser 10, the pegs 16 are placed within the apertures 17 and the pegs 40 are slid into the slots 15. The handle 13 is not meant to slide within the slots 15 during operation of the dispenser 10 but rather to assist in operatively connecting the handle 13 to the dispenser 10. When the handle 13 is compressed, the handle lever assembly 25 or 25' compresses the product outlet piston 23, which is described in U.S. Pat. No. 5,779,104. The movement of the handle lever assembly 25 or 25' is described below.

Figure 3:
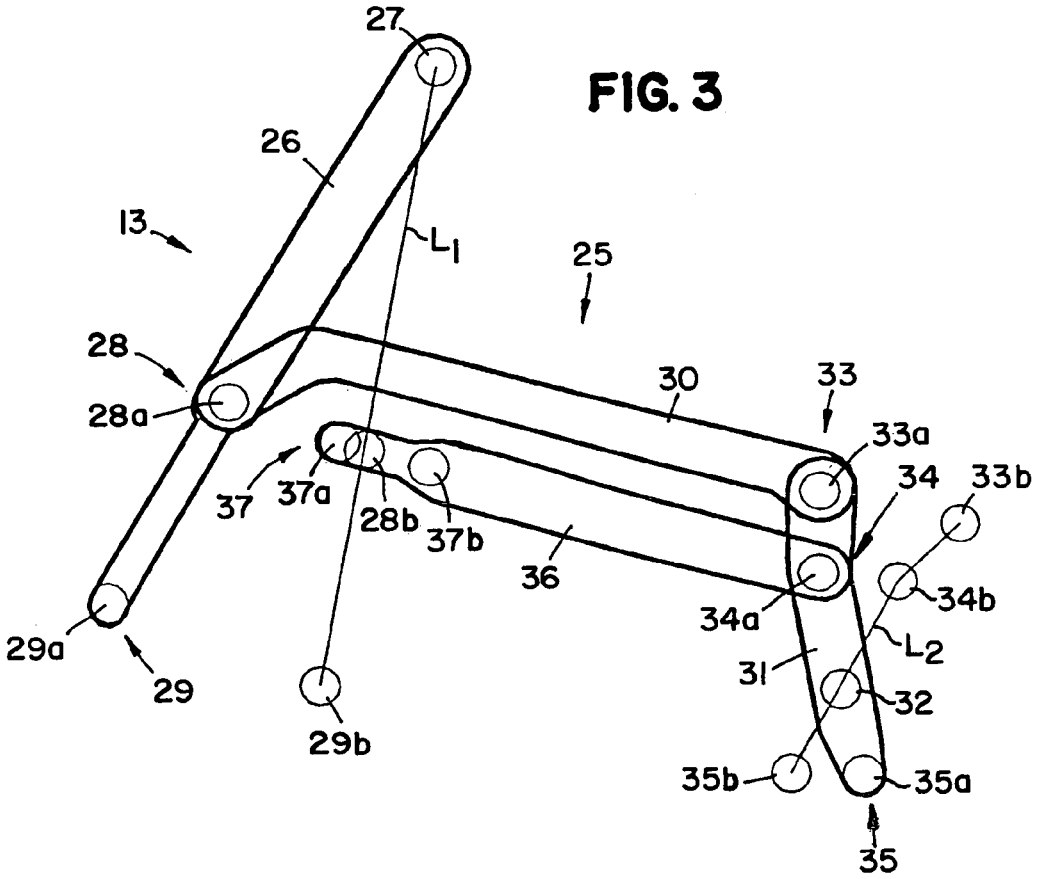
FIG. 3 is a right side schematic view of a lever for use with the dispenser and the handle shown in FIG. 1.

FIG. 3 shows a right side view of a handle lever assembly 25 including a push bar lever 26, a motion bar 30, a rotation lever 31, and a draw bar 36. The assembly 25 includes a corresponding left side, which is a mirror image of these components shown in the right side view. The push bar lever 26 is a relatively straight bar extending relatively upwardly and includes a pivot point 27 proximate the top of the bar. Although the terms upwardly, horizontally, and downward are being used herein to describe the relative orientations of the handle lever assembly 25 components to one another, these terms are being used figuratively and should not be construed as limiting these components to these literal orientations. For example, the push bar lever 26 is oriented in a relatively upward position and is approximately 45 degrees from being truly vertical. The pivot point 27 is operatively connected to the dispenser 10 to pivot back and forth as the push bar lever 26 is pushed and released. In FIG. 1, the push bar lever 26 is shown as handle 13 and the pivot point 27 is shown as apertures 17.

The push bar lever 26 also includes an attachment point 28 proximate the middle portion of the bar and a push member 29 extending from the attachment point 28 to the end of the bar. The push member 29 is where the push bar lever 26 is pushed by a hand, and the attachment point 28 is the point at which the push bar lever 26 is operatively connected to the motion bar 30. As discussed above, this attachment point 28 is also where the pegs 40 are located to slide within the slots 15. The motion bar 30 extends generally horizontally from the push bar lever 26 and includes an attachment point 33, to which the rotation lever 31 is operatively connected.

Figure 4:
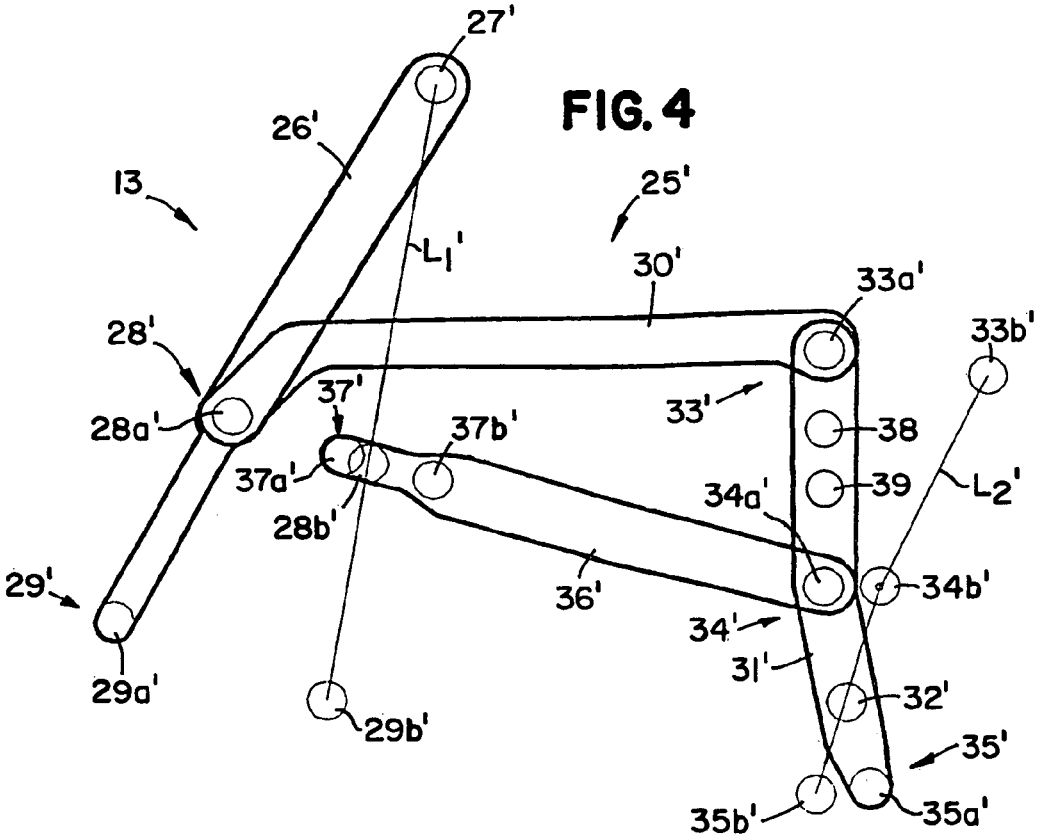
FIG. 4 is a right side schematic view of a lever for use with the dispenser and the handle shown in FIG. 1.

Since FIGS. 3 and 4 are schematic views of the handle lever assemblies 25 and 25', the push bar levers 26 and 26', including the push members 29 and 29', are functionally the same as the handle 13 of FIGS. 1 and 2 even though they do not have the same outer appearance in the figures. The push bar levers 26 and 26' and the push members 29 and 29' are one piece that pivot together about pivot points 27 and 27', respectively. Likewise, the pivot points 27 and 27' are functionally the same as the apertures 17 of FIG. 1 even though they do not have the same outer appearance in the figures.

The rotation lever 31 extends generally downward from the motion bar 30 and includes a pivot point 32, an attachment point 34, and an end 35. The pivot point 32 includes pegs (not shown) extending inwardly that are configured and arranged to engage corresponding apertures (not shown) in the dispenser 10. The attachment point 34 provides a point to which the draw bar 36 is operatively connected. Proximate the attachment point 34 the rotation lever 31 slightly dog legs outward toward the back of the dispenser to assist in the pivoting of the draw bar 36. The draw bar 36 includes an end 37, which includes a bar 41 extending to the opposite side of the draw bar 36. The bar 41 is the portion of the assembly 25 that compresses the product outlet piston 23 to dispense the product.

In operation, the push bar lever 26, the motion bar 30, the rotation lever 31, and the draw bar 36 are operatively connected, as discussed above, and are pivotable at each of the respective attachment points to move the handle lever assembly 25. First, as the push member 29 is being compressed, the push bar lever 26 is pivoted to a more upright position, as illustrated by line $L_1$ in FIG. 3. The pivot point 27 remains in place while the attachment point 28 moves from a first position 28*a* to a second position 28*b* and the push member 29 moves from a first position 29*a* to a second position 29*b*. This movement pushes motion bar 30 backward toward the back of the dispenser thereby causing the rotation lever 31 to move, as illustrated by line $L_2$. The pivot point 32 remains in place while the attachment point 33 moves from a first position 33*a* to a second position 33*b*, the attachment point 34 moves from a first position 34*a* to a second position 34*b*, and the end 35 moves from a first position 35*a* to a second position 35*b*. This clockwise rotation causes the draw bar 36 to move backward toward the back of the dispenser thereby moving the end 37 from a first position 37*a* to a second position 37*b*. The linear movement of the draw bar 36 is what causes the bar 41 to compress the product outlet piston 23. This embodiment delivers approximately 11 mm of draw bar motion (approximately 0.8 ml of soap), requires approximately 28 mm of push lever motion, and requires approximately 4 pounds of force to operate.

FIG. 4 shows a right side view of a handle lever assembly 25' including a push bar lever 26', a motion bar 30', a rotation lever 31', and a draw bar 36'. A left side view of the handle lever assembly 25' is shown in FIG. 5. The assembly 25' includes a corresponding left side, which is a mirror image of these components shown in the right side view. The push bar lever 26' is a relatively straight bar extending relatively upwardly and includes a pivot point 27' proximate the top of the bar. Again, although the terms upwardly, horizontally, and downward are being used herein to describe the relative orientations of the handle lever assembly 25' components to one another, these terms are being used figuratively only and should not be construed as limiting these components to these literal orientations. For example, the push bar lever 26' is oriented in a relatively upward position and is approximately 45 degrees from being truly vertical. The pivot point 27' is operatively connected to the dispenser 10 to pivot back and forth as the push bar lever 26' is pushed and released. Again, as discussed above, the push bar lever 26' is shown as handle 13 in FIGS. 1 and 2 and the pivot point 27' is shown as apertures 17 in FIG. 1.

The push bar lever 26' also includes an attachment point 28' proximate the middle portion of the bar and a push member 29' extending from the attachment point 28' to the end of the bar. The push member 29' is where the push bar lever 26' is pushed by a hand, and the attachment point 28' is the point at which the push bar lever 26' is operatively connected to the motion bar 30'. As discussed above, this attachment point 28' is also where the pegs 40 are located to slide within the slots 15. The motion bar 30' extends generally horizontally from the push bar lever 26' and includes an attachment point 33', to which the rotation lever 31' is operatively connected.

The rotation lever 31' extends generally downward from the motion bar 30' and includes a pivot point 32', an attachment point 34', and an end 35'. The pivot point 32' includes pegs (not shown) extending inwardly that are configured and arranged to engage corresponding apertures (not shown) in the dispenser 10. The attachment point 34' provides a point to which the draw bar 36' is operatively connected. Proximate the attachment point 34' the rotation lever 31' slightly dog legs outward toward the back of the dispenser to assist in the pivoting of the draw bar 36'. The draw bar 36' includes an end 37', which includes a bar 41 extending to the opposite side of the draw bar 36'. The bar 41 is the portion of the assembly 25' that compresses the product outlet piston 23 to dispense the product.

In operation, the push bar lever 26', the motion bar 30', the rotation lever 31', and the draw bar 36' are operatively connected, as discussed above, and are pivotable at each of the respective attachment points to move the handle lever assembly 25'. First, as the push member 29' is being compressed, the push bar lever 26' is pivoted to a more upright position, as illustrated by line $L_1'$ in FIG. 4. The pivot point 27' remains in place while the attachment point 28' moves from a first position 28*a*' to a second position 28*b*' and the push member 29' moves from a first position 29*a*' to a second position 29*b*'. This movement pushes motion bar 30' backward toward the back of the dispenser thereby causing the rotation lever 31' to move, as illustrated by line $L_2'$. The pivot point 32' remains in place while the attachment point 33' moves from a first position 33*a*' to a second position 33*b*', the attachment point 34' moves from a first position 34*a*' to a second position 34*b*', and the end 35' moves from a first position 35*a*' to a second position 35*b*'. This clockwise rotation causes the draw bar 36' to move backward toward the back of the dispenser thereby moving the end 37' from a first position 37*a*' to a second position 37*b*'. The linear movement of the draw bar 36' is what causes the bar 41 to compress the product outlet piston 23. This embodiment delivers approximately 7 mm of draw bar motion (approximately 0.5 ml of soap), requires approximately 28 mm of push lever motion, and requires approximately 2.5 pounds of force to operate. This embodiment is particularly useful for children, handicapped people, and older people because less force is required.

With the handle lever assemblies, the motion bar and the draw bar are on the same vertical plane so the overall width of the assembly is reduced. In comparing the two embodiments shown in FIGS. 3 and 4, the handle lever assembly 25 requires more force than the handle lever assembly 25' because the draw bar must travel a greater distance, however, more soap is dispensed due to the greater distance. The handle lever assembly 25' requires less force because the draw bar must travel a lesser distance and, therefore, less soap dispensed.

In another embodiment, the rotation lever could have multiple holes between the two attachment points shown in FIG. 4. More specifically, an attachment point 38 and an attachment point 39 could be located between the attachment points 33' and 34' and the draw bar could be connected to any one of the attachment points except the attachment point to which the motion bar is connected. FIG. 5 shows an additional attachment point 38 between the attachment points 33' and 34'. Although one and two additional attachment points are shown, it is recognized that any number of additional attachment points could be used. With several points of attachment for the draw bar, the draw bar could be located along the rotation lever to change the amount of force required to dispense a desired amount of soap. In other words, the closer the draw bar is to the motion bar, the more force would be required to dispense more soap and, conversely, the further away the draw bar is to the motion bar, the less force would be required to dispense less soap. With this changeable output feature (the adjustable positions for attachment of the draw bar on the rotation lever), the dispenser may be set for standard pressure operation, which just meets the ADA requirements, or light pressure operation, which requires less force to operate the dispenser and less soap is delivered.

In addition to dispensing foaming hand soap, there are other possible applications for the present invention. Some other possible applications include foaming bath soap or shower gel, shampoo, and foaming waterless grease hand cleanser. However, this list is not exhaustive.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispensing system for dispensing a product, comprising:

a) a dispenser including a housing, a push handle, and a pivot point to which said push handle is operatively connected, said housing having a cavity, a first inner surface and a second inner surface, said first inner surface including a first lock-out member and said second inner surface including a second lock-out member;

b) a bottle including a first mating lock-out member and a second mating lock-out member, said first mating lock-out member being configured and arranged to mate with said first lock-out member and said second mating lock-out member being configured and arranged to mate with said second lock-out member when said bottle is placed within said cavity of said dispenser;

c) an anti-pinch member including a curved surface and a lip proximate a top portion of said curved surface, said curved surface filling a gap between said housing and said push handle when said push handle is compressed, said lip extending outward from said curved surface to close off the gap proximate said top portion of said curved surface; and d) a handle lever assembly including a push bar lever, a motion bar, a rotation lever, and a draw bar, said push bar lever extending relatively upwardly and including a first pivot point proximate a top portion thereof and a first attachment point in a middle portion thereof, said motion bar being operatively connected to said first attachment point and extending relatively horizontally from said push bar lever, said motion bar including a second attachment point in an end opposite said first attachment point, said rotation lever being operatively connected to said second attachment point and extending relatively downward from said motion bar, said rotation lever including a third attachment point in a middle portion thereof and a second pivot point below said third attachment point, and said draw bar being operatively connected to said third attachment point of said rotation lever, wherein when said push bar lever is pushed inward said push bar lever pivots at said first pivot point thereby causing said motion bar to move backward toward a back portion of the dispenser, said rotation lever pivoting at said second pivot point and rotating clockwise thereby causing said draw bar to move backward toward the back portion of the dispenser.

2. The dispensing system of claim 1, wherein said first lock-out member and said second lock-out member are protrusions extending from said inner surfaces of said housing and said first mating lock-out member end said second lock-out member are notches in said bottle, said protrusions configured and arranged to fit within said notches when said bottle is placed within said cavity of said dispenser.

3. A handle lever assembly for use with a product dispenser having a push handle, comprising:

a) a push bar lever extending relatively upwardly and including a first attachment point in a middle portion Thereof;

b) a motion bar operatively connected to said first attachment point and extending relatively horizontally from said push bar lever, said motion bar including a second attachment point in an end opposite said first attachment point;

c) a rotation lever operatively connected to said second attachment point and extending relatively downward from said motion bar, said rotation lever including a third attachment point in a middle portion thereof and including multiple points of attachment between said second attachment point and said third attachment point; and d) a draw bar operatively connected to said rotation lever, said draw bar being adjustable along said multiple points of attachment and said third attachment point of said rotation lever to operatively connect thereto.

4. The handle lever assembly of claim 3, wherein placement of said draw bar more proximate said motion bar requires more force to move the handle lever assembly.

5. The handle lever assembly of claim 3, wherein placement of said draw bar further from said motion bar requires less force to move the handle lever assembly.

6. A handle lever assembly for use with a product dispenser having a push handle, comprising:

a) a push bar lever extending relatively upwardly and including a first pivot point proximate a top portion thereof and a first attachment point in a middle portion thereof;

b) a motion bar operatively connected to said first attachment point and extending relatively horizontally from said push bar lever, said motion bar including a second attachment point in an end opposite said first attachment point;

c) a rotation lever operatively connected to said second attachment point and extending relatively downward from said motion bar, said rotation lever including a third attachment point in a middle portion thereof and a second pivot point below said third attachment point; and d) a draw bar operatively connected to said third attachment point of said rotation lever, wherein when said push bar lever is pushed inward said push bar lever pivots at said first pivot point thereby causing said motion bar to move backward toward a back portion of the dispenser, said rotation lever pivoting at said second pivot point and rotating clockwise thereby causing said draw bar to move backward toward the back portion of the dispenser.

7. The handle lever assembly of claim 6, wherein said draw bar travels a greater distance the closer said draw bar is to said motion bar.

8. An anti-pinch member for use with a dispenser, the dispenser including a housing, a push handle for dispensing a product, and a pivot point to which the push handle is operatively connected, the housing covering the pivot point and a portion of the push handle operatively connected to the pivot point, wherein a gap is created proximate the pivot point between the housing and the push handle when the push handle is compressed, comprising:

a) a curved surface, said curved surface filling the gap between the housing and the push handle when the push handle is compressed; and b) a lip proximate a top portion of said curved surface, said lip extending outward from said curved surface to close off the gap proximate said top portion of said curved surface.

* * * * *

UNITED STATES PATENT AND TRADEMARK OFFICE
Certificate

Patent No. 7,066,356 B2 Patented: June 27, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Allan L. Schuman, Eden Prairie, MN (US); Tina O. Outlaw, Inver Grove Heights, MN (US); Darren M. Jahnke, Woodbury, MN (US); Louis M. Holzman, St. Paul, MN (US); Randall S. Williams, Chaska, MN (US); Paul A. Pilosi, Minnetonka, MN (US); Timothy W. Kidder, St. Paul, MN (US); and Carrie A. Kroll, Richfield, MN (US).

Signed and Sealed this Fourteenth Day of August 2012.

KEVIN P. SHAVER
*Supervisory Patent Examiner*
Art Unit 3754
Technology Center 3700

UNITED STATES PATENT AND TRADEMARK OFFICE

CERTIFICATE OF CORRECTION

PATENT NO. : 7,066,356 B2
APPLICATION NO. : 10/336054
DATED : June 27, 2006
INVENTOR(S) : Allan L. Schuman et al.

It is certified that error appears in the above-identified patent and that said Letters Patent is hereby corrected as shown below:

Col. 9, line 20, Claim 3(a): "Thereof" should read --thereof--

Signed and Sealed this
Eighteenth Day of September, 2012

David J. Kappos

David J. Kappos
*Director of the United States Patent and Trademark Office*